US007462795B2

(12) United States Patent
Montalvo

(10) Patent No.: US 7,462,795 B2
(45) Date of Patent: Dec. 9, 2008

(54) ROTARY KNOB WITH A DISPLAY

(75) Inventor: Juan J. Montalvo, Juarez (MX)

(73) Assignee: Delphi Technologies, Inc., Troy, MI (US)

( * ) Notice: Subject to any disclaimer, the term of this patent is extended or adjusted under 35 U.S.C. 154(b) by 159 days.

(21) Appl. No.: 11/496,190

(22) Filed: Jul. 31, 2006

(65) Prior Publication Data

US 2008/0023309 A1 Jan. 31, 2008

(51) Int. Cl.
*H01H 19/02* (2006.01)

(52) U.S. Cl. ..... 200/336; 200/564; 200/11 R

(58) Field of Classification Search ..... 200/4, 200/11 R, 17 R, 564–570, 329, 332, 336, 200/341

See application file for complete search history.

(56) References Cited

U.S. PATENT DOCUMENTS

| | | | | |
|---|---|---|---|---|
| 6,512,189 | B1 * | 1/2003 | Schuberth et al. | 200/334 |
| 6,667,446 | B1 * | 12/2003 | Schuberth et al. | 200/4 |
| 7,140,551 | B2 * | 11/2006 | de Pauw et al. | 236/94 |
| 7,157,651 | B2 * | 1/2007 | Rix et al. | 200/5 A |
| 2004/0245080 | A1 * | 12/2004 | Turner | 200/329 |
| 2005/0001821 | A1 | 1/2005 | Low | |

FOREIGN PATENT DOCUMENTS

| | | |
|---|---|---|
| DE | 10261284 | 7/2004 |
| EP | 0771681 | 5/1997 |
| EP | 1102294 | 5/2001 |
| GB | 2093240 | 8/1982 |
| GB | 2212317 | 7/1989 |
| WO | 03017304 | 2/2003 |
| WO | 20040121178 | 2/2004 |
| WO | 2006/010513 | 2/2006 |

OTHER PUBLICATIONS

EP Search Report dated Oct. 30, 2007.

* cited by examiner

*Primary Examiner*—Elvin Enad
*Assistant Examiner*—Marina Fishman
(74) *Attorney, Agent, or Firm*—Jimmy L. Funke

(57) ABSTRACT

A knob assembly comprising a rotary knob, a rotary actuated potentiometer and an electronic display. The rotary knob has a central opening and is configured to rotate. The rotary actuated potentiometer is actuated by rotation of the rotary knob. The electronic display is located within the central opening of the rotary knob. The electronic display does not rotate with rotation of the rotary knob.

9 Claims, 4 Drawing Sheets

ROTARY KNOB WITH A DISPLAY

TECHNICAL FIELD

The present invention concerns control assemblies, and more particularly relates to control assemblies having a knob force transfer.

BACKGROUND OF THE INVENTION

Control assemblies using buttons and knobs can be used in a wide variety of applications. For example, buttons can be used in vehicles to control a radio, air conditioning or many other features. Furthermore, the control assemblies can typically be used in any application that has switches actuated by buttons or knobs.

An improved control assembly is desired.

SUMMARY OF THE INVENTION

An aspect of the present invention is to provide a knob assembly comprising a rotary knob, a rotary actuated potentiometer and an electronic display. The rotary knob has a central opening and is configured to rotate. The rotary actuated potentiometer is actuated by rotation of the rotary knob. The electronic display is located within the central opening of the rotary knob. The electronic display does not rotate with rotation of the rotary knob.

Another aspect of the present invention is to provide a method of displaying and controlling an electronic component. The method comprises providing a rotary knob having a central opening therein, with the rotary knob being configured to rotate. The method further comprises rotating a rotary actuated potentiometer by rotating the rotary knob and providing an electronic display within the central opening of the rotary knob. The electronic display does not rotate with rotation of the rotary knob.

These and other aspects, objects, and features of the present invention will be understood and appreciated by those skilled in the art upon studying the following specification, claims, and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
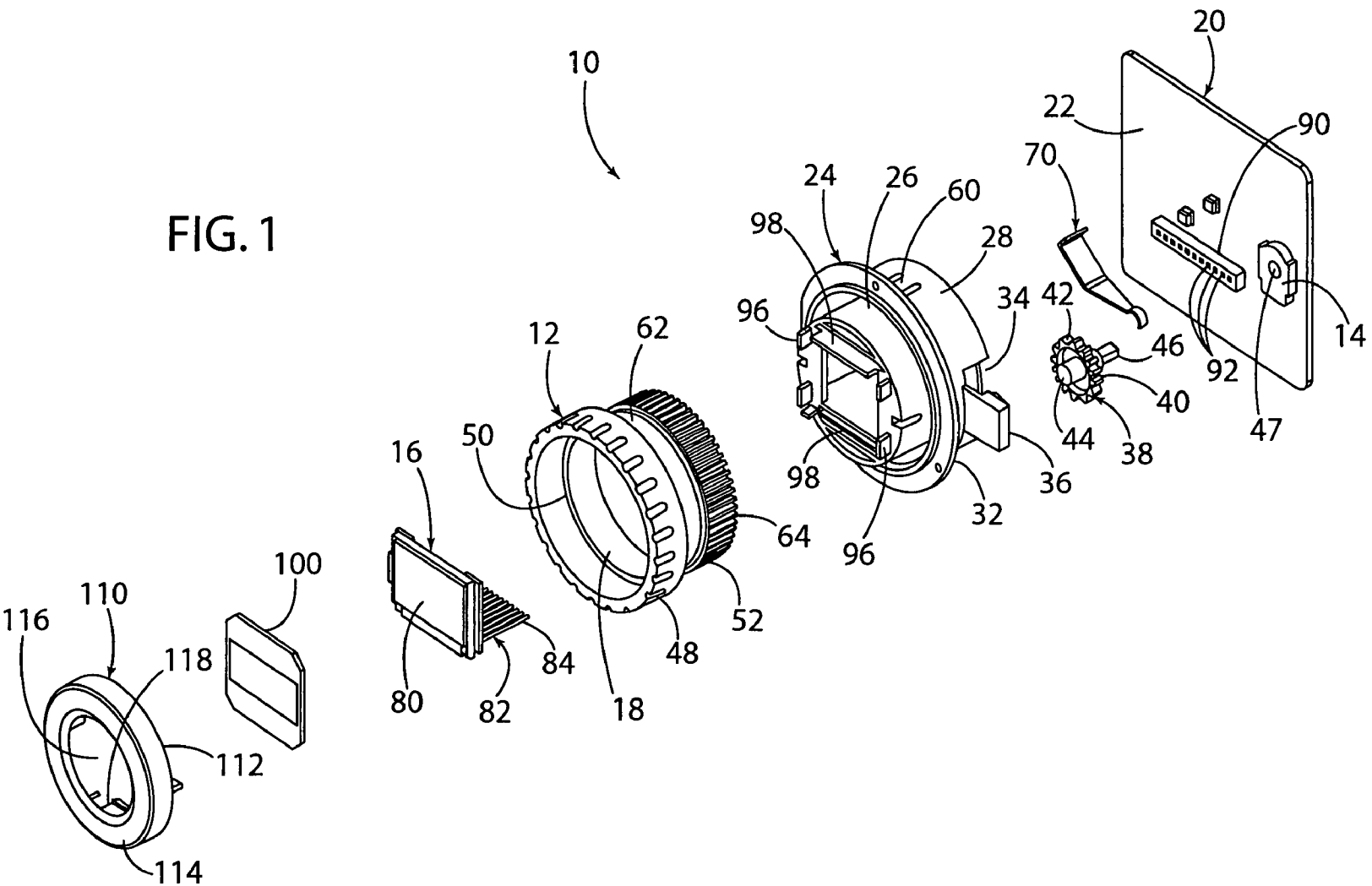
FIG. 1 is an isometric exploded view of a knob assembly of the present invention.

For purposes of description herein, orientation terms shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-2) generally designates a knob assembly embodying the present invention. In the illustrated example, the knob assembly 10 comprises a rotary knob 12, a rotary actuated potentiometer 14 and an electronic display 16. The rotary knob 12 has a central opening 18 and is configured to rotate. The rotary actuated potentiometer 14 is actuated by rotation of the rotary knob 12. The electronic display 16 is located within the central opening 18 of the rotary knob 12. The electronic display 16 does not rotate with rotation of the rotary knob 12.

The illustrated knob assembly 10 is preferably used in a vehicle to control at least one of the electronic components of the vehicle. For example, the knob assembly 10 can be used to control an audio system, a heating, ventilating and air-conditioning system (HVAC), a navigation system, an infotainment system or any other system. The knob assembly 10 is preferably placed in a housing (possibly having a front module portion and a rear module portion with the knob assembly 10 therein). However, the housing of the knob assembly 10 could include only one module portion or any part of the vehicle (or other location of the knob assembly 10) itself. The module is preferably configured to be installed into a corresponding slot for receiving the module in an instrument panel of the vehicle.

In the illustrated embodiment, the knob assembly 10 includes a circuit board 20 located within the housing and including circuits printed thereon for controlling the audio system, the heating, ventilating and air-conditioning system (HVAC), the navigation system, the infotainment system or any other system. The circuit board 20 can be single or double sided. The rotary actuated potentiometer 14 is preferably surface mounted to a front 22 of the circuit board 20. As is well known to those skilled in the art, the rotary actuated potentiometer 14 is used to change the resistance of a circuit to thereby alter the output of the circuit (e.g., raise or lower volume of an audio system, raise or lower the temperature of an HVAC system, etc.) The rotary knob 12 is configured to transfer rotary force to the rotary actuated potentiometer 14 to adjust the rotary actuated potentiometer 14 to a desired resistance.

Figure 2:
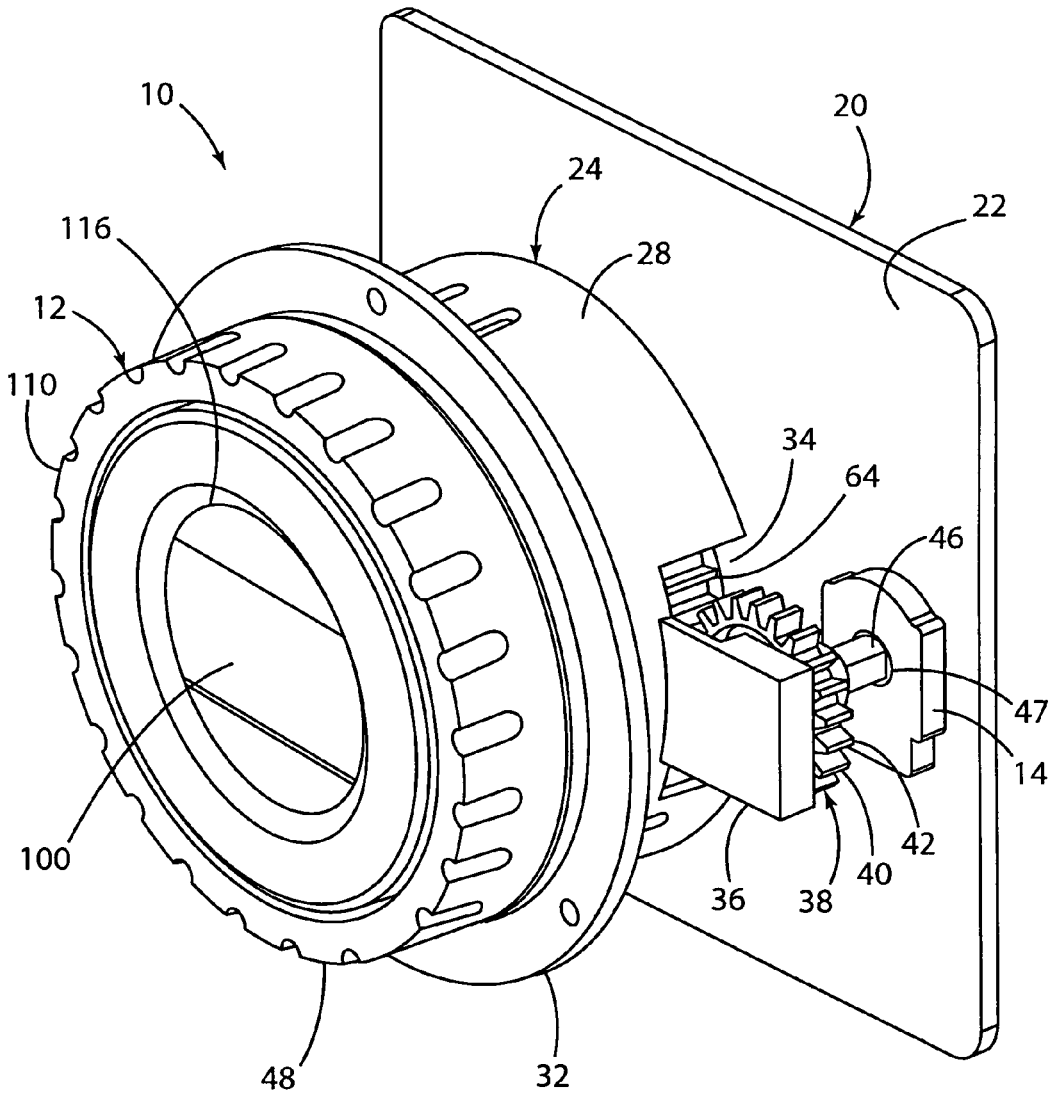
FIG. 2 is an isometric view of the knob assembly of the present invention.

The illustrated knob assembly 10 includes a knob shell 24 that is fixed in position within the housing relative to the circuit board 20 and that accepts the rotary knob 12 therein. The knob shell 24 is preferably made of plastic, although other materials are contemplated (e.g., metal). The knob shell 24 includes an inner cylinder 26, an outer cylinder 28, an annular ring plate 30 connecting a rear of the inner cylinder 26 to a rear of the outer cylinder 28, and an annular flange 32 extending from a periphery of the outer cylinder 28. As illustrated in FIG. 2, the knob shell 24 includes a gear slot 34 in the outer cylinder 28 and a portion of the annular ring plate 30. The outer cylinder 28 further includes a pin housing 36 extending outwardly therefrom adjacent the gear slot 34. The knob shell 24 is configured to accept the rotary knob 12 between the inner cylinder 26 and the outer cylinder 28. It is contemplated that the knob shell 24 could be fixed to the housing or be part of the housing described above.

In the illustrated example, a transfer gear 38 is connected to the knob shell 24 and the rotary actuated potentiometer 14 and is configured to actuate the rotary actuated potentiometer 14. The transfer gear 38 includes a center gear wheel 40 having teeth 42, a front pin 44 extending forwardly from the center gear wheel 40 and a rear pin 46 extending rearwardly from the center gear wheel 40. The rear pin 46 is configured to extend into a corresponding opening 47 in the rotary actuated potentiometer 14 to actuate the rotary actuated potentiometer 14 as is well known to those skilled in the art. Preferably, the rear pin 46 is non-circular. The front pin 44 is circular and extends into an opening (which is also circular) in a rear of the pin housing 36 extending from the outer cylinder 28 of the knob shell 24. Therefore, the rotary actuated potentiometer 14 and the pin housing 36 extending from the outer cylinder 28 of the knob shell 24 maintain the transfer gear 38 in position, but allow the transfer gear 38 to rotate. The transfer gear 38 transmits rotary force from the rotary knob 12 to the rotary actuated potentiometer 14.

Figure 3:
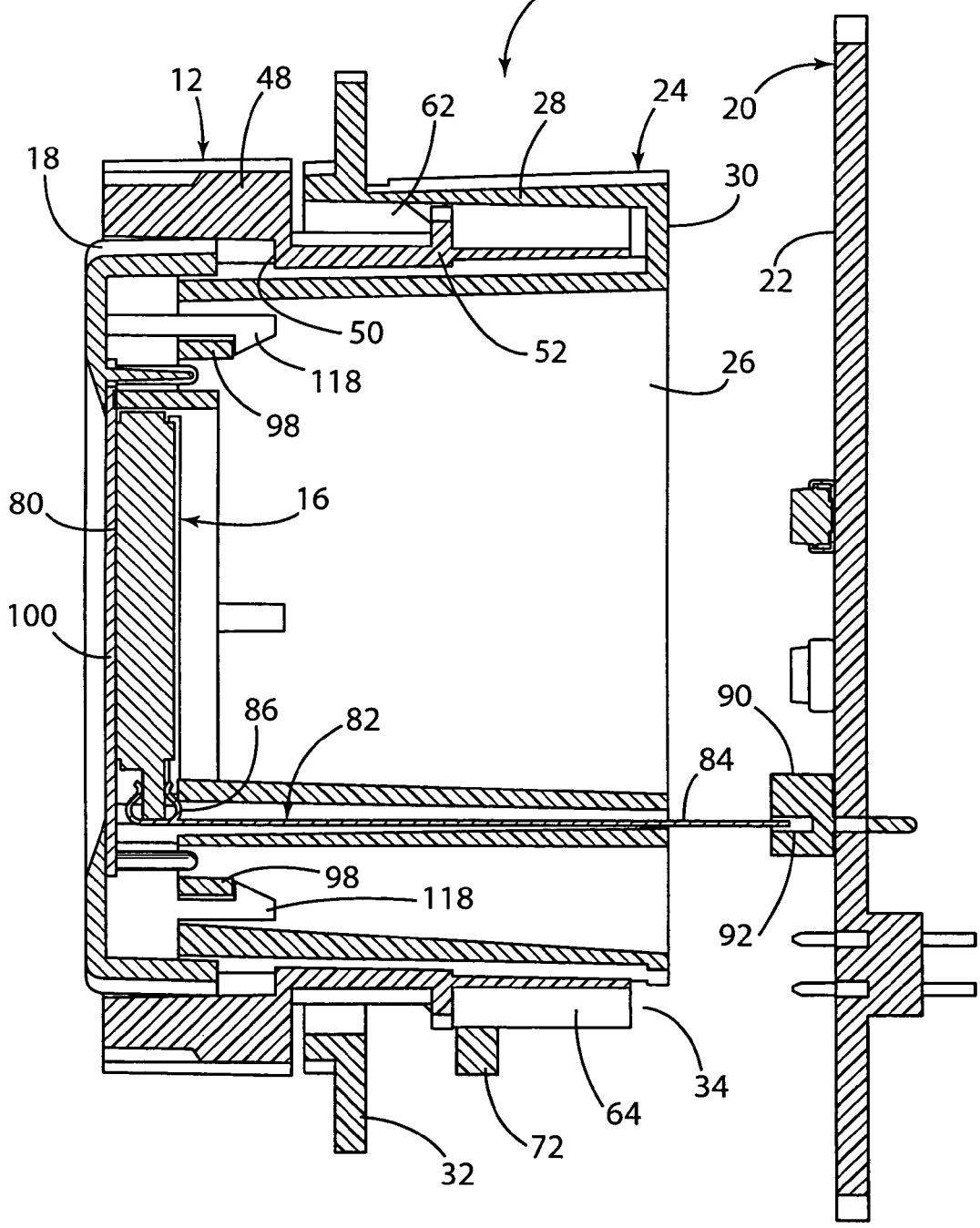
FIG. 3 is a cross-sectional view of the knob assembly of the present invention.
Figure 4:
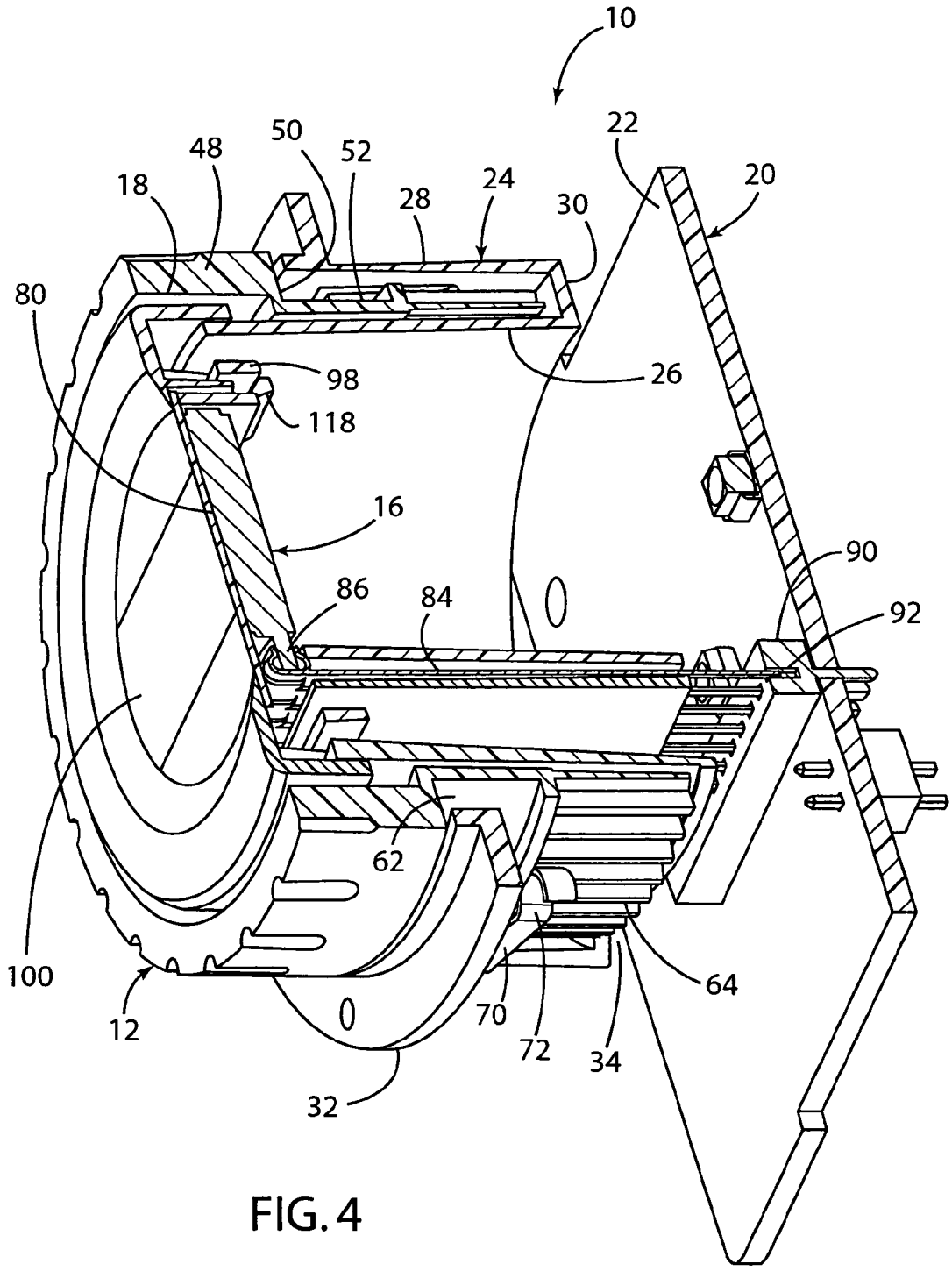
FIG. 4 is an isometric cross-sectional view of the knob assembly of the present invention.

In the illustrated example, the rotary knob 12 can be rotated to transfer rotary force to the rotary actuated potentiometer 14 via the transfer gear 38. The rotary knob 12 is preferably made of plastic, although other materials are contemplated (e.g., metal). The rotary knob 12 includes a front tube portion 48, a transition portion 50 and a rear tube portion 52. As illustrated in FIGS. 3 and 4, the rear tube portion 52 of the rotary knob 12 is inserted between the inner cylinder 26 and the outer cylinder 28 of the knob shell 24, with the front tube portion 48 being located in front of the outer cylinder 28 of the knob shell 24. Furthermore, an inner surface of the outer cylinder 28 of the knob shell 24 includes at least one projection 60 configured to be inserted into a circular slot 62 on an outer surface of the rear tube portion 52 of the rotary knob 12. Therefore, the rotary knob 12 is connected to the knob shell 24 by inserting the rear tube portion 52 between the inner cylinder 26 and the outer cylinder 28 of the knob shell 24. As the rear tube portion 52 abuts at least one projection 60, a ramped front surface of the at least one projection 60 abuts against the end of the rear tube portion 52 and bends outward until the at least one projection 60 can fit within the circular slot 62. Therefore, the rotary knob 12 can rotate within the knob shell 24. The rear tube portion 52 includes knob teeth 64 on an end thereof. The knob teeth 64 engage the teeth 42 of the center gear wheel 40 of the transfer gear 38 through the gear slot 34 in the knob shell 24.

Accordingly, according to the knob assembly 10 of the present invention, rotation of the rotary knob 12 transmits rotary force to the rotary actuated potentiometer 14. Rotation of the rotary knob 12 causes the knob teeth 64 thereon to rotate. The knob teeth 64 will thereafter transfer rotary motion to the teeth 42 of the transfer gear 38 through the gear slot 34 in the knob shell 24, thereby causing the transfer gear 38 to rotate. Rotation of the transfer gear 38 will cause rotation of the rear pin 46 of the transfer gear 38 to rotate, thereby adjusting the rotary actuated potentiometer 14 to a desired resistance. Preferably, rotation of the rotary knob 12 transmits rotary force to the rotary actuated potentiometer 14 via the transfer gear 38 on a 1:1 rotational basis. However, other rotational bases are contemplated. Furthermore, as illustrated in FIG. 4, a leaf spring 70 includes a curved end 72 that is biased against the knob teeth 64 of the rotary knob 12. The curved end 72 extends into spaces between the knob teeth 64 as the rotary knob 12 is rotated thereby providing a detent feel to the rotary knob 12. Accordingly, the person rotating the rotary knob 12 will know when the rotary knob 12 is rotated to a particular position (e.g., between three settings: fan low, fan medium, and fan high). It is contemplated that other methods of providing a detent feel could be used.

In the illustrated example, the electronic display 16 is fixed in position relative to the knob shell 24 and the circuit board 20 and does not rotate with rotation of the rotary knob 12. The electronic display 16 is preferably an LCD display or a vacuum fluorescent display. However, any electronic display 16 is contemplated. The electronic display 16 includes a display portion 80 for displaying any image capable of being displayed by the electronic display 16. The electronic display 16 also includes a clip 82 connected to a bottom of the display portion 80. The clip 82 includes a front U-shaped clip portion 86 accepting a bottom of the display portion 80 therein and plurality of rearwardly extending lead pins 84 extending from the clip portion 86 at a bottom of the display portion 80. The rearwardly extending lead pins 84 are configured to be inserted into a connector block 90 on the front of the circuit board 20. The connector block 90 includes a plurality of pin openings 92 for accepting the rearwardly extending lead pins 84 therein to power the electronic display 16 and to change the image on the electronic display 16. The illustrated electronic display 16 preferably includes a protective applique 100 connected to a front of the display portion 80 for protecting the display portion 80. The display portion 80 of the electronic display 16 is configured to fit between a plurality of vertical flanges 96 and horizontal flanges 98 that form a square and that extend from the front of the inner cylinder 26 of the knob shell 24 as illustrated in FIGS. 1, 3 and 4.

The illustrated rotary assembly 10 includes a cap 110 covering the electronic display 16 and the protective applique 100. The cap 110 includes a tube 112 and an annular ring plate 114 defining a central opening 116 in the front of the cap 110. The electronic display 16 can be seen through the central opening 116 in the cap 110. The cap 110 is preferably statically connected to the knob shell 24. An inner surface of the annular ring plate 114 includes a plurality of hooks 118 extending rearwardly therefrom. The hooks 118 snap behind the vertical flanges 96 or the horizontal flanges 98 of the knob shell 24 as illustrated in FIGS. 3 and 4.

Accordingly, the knob assembly 10 of the present invention is configured to activate the rotary actuated potentiometer 14 located on the circuit board 20 using the rotary knob 14 and also to include the electronic display 16 within the rotary knob 12 that does not rotate with the rotary knob 12.

It will be understood by those who practice the invention and those skilled in the art, that various modifications and improvements may be made to the invention without departing from the spirit of the disclosed concept. For example, the rotary actuated potentiometer 14 could be a ring potentiometer that surrounds the rotary knob 12 and that is actuated directly by rotation of the rotary knob 12. Additionally, the rotary actuated potentiometer 14 could be connected to a rear of the circuit board, with the transfer gear extending through or around the circuit board. Furthermore, it is contemplated that instead of the pins on the electronic display, the electronic display could be powered and controlled via a contact strip (e.g., made of rubber) that is engaged with the electronic display and is formed on the knob shell to extend between the electronic display and the circuit board. The scope of protection afforded is to be determined by the claims and by the breadth of interpretation allowed by law.

The invention claimed is:

1. A knob assembly comprising:

a rotary knob having a central opening, the rotary knob including a rear tube portion with a circular slot on an outer surface of the rear tube portion;

a knob shell including an inner cylinder, and an outer cylinder, the outer cylinder having an inner surface that includes at least one projection, the knob shell being configured to accent the rotary knob between the inner cylinder and the outer cylinder with the projection fitting within the circular slot of the rotary knob;

a rotary actuated potentiometer actuated by rotation of the rotary knob; and an electronic display located within the central opening of the rotary knob and connected to the knob shell, the electronic display being configured to fit between a plurality of flanges extending from a front surface of the inner cylinder;

wherein the electronic display does not rotate with rotation of the rotary knob.

2. The knob assembly of claim 1, further including:

a circuit board having the rotary actuated potentiometer connected thereto.

3. The knob assembly of claim 2, wherein:

the circuit board has a connector thereon, the connector including a plurality of electronic contacts located within openings in the connector; and the electronic display includes a plurality of pins inserted into the opening of the circuit board to power the electronic display.

4. The knob assembly of claim 1, further including:

a transfer gear transferring the rotary motion of the rotary knob to the rotary actuated potentiometer.

5. The knob assembly of claim 1, wherein the knob shell does not rotate with rotation of the rotary knob.

6. The knob assembly of claim 5, further including:

a cap connected to the knob shell, the cap having a central aperture wherein the electronic display can be viewed through the central aperture.

7. The knob assembly of claim 1, wherein:

the electronic display is a liquid crystal display.

8. The knob assembly of claim 1, wherein:

the electronic display is a vacuum florescence display.

9. The knob assembly of claim 1, further including:

a protective appliqué in front of the electronic display to protect the electronic display.

* * * * *